US006799582B2

(12) United States Patent
Kim

(10) Patent No.: US 6,799,582 B2
(45) Date of Patent: Oct. 5, 2004

(54) COSMETIC CONTAINER

(76) Inventor: Yoon-Hoi Kim, 2902 Samsung Borame Omnitower #395-62, Sindaebang2-Dong, Dongjak-Gu, Seoul (KR), 156-012

( * ) Notice: Subject to any disclaimer, the term of this patent is extended or adjusted under 35 U.S.C. 154(b) by 261 days.

(21) Appl. No.: 10/169,107

(22) PCT Filed: Jul. 20, 2001

(86) PCT No.: PCT/KR01/01241

§ 371 (c)(1),
(2), (4) Date: Jul. 15, 2002

(87) PCT Pub. No.: WO02/39845

PCT Pub. Date: May 23, 2002

(65) Prior Publication Data

US 2003/0000543 A1 Jan. 2, 2003

(30) Foreign Application Priority Data

Nov. 16, 2000 (KR) ..... 2000-32088

(51) Int. Cl.[7] ..... A45D 40/26; A46B 11/00
(52) U.S. Cl. ..... 132/317; 401/127; 401/129
(58) Field of Search ..... 132/218, 317, 132/320; 401/126, 127, 129

(56) References Cited

U.S. PATENT DOCUMENTS

| | | | | | |
|---|---|---|---|---|---|
| 2,195,472 | A | * | 4/1940 | Ladislaus Szucs et al. | 132/317 |
| 2,695,028 | A | * | 11/1954 | Murray | 132/318 |
| 4,841,996 | A | * | 6/1989 | Gueret | 132/320 |
| 4,886,387 | A | | 12/1989 | Goldberg et al. | |
| 4,927,281 | A | | 5/1990 | Gueret | |
| 5,121,763 | A | * | 6/1992 | Kingsford | 132/317 |
| 6,164,857 | A | * | 12/2000 | Wolfarth-Brooks et al. | 401/127 |
| 6,309,125 | B1 | * | 10/2001 | Peters | 401/127 |

FOREIGN PATENT DOCUMENTS

| | | | |
|---|---|---|---|
| JP | 58-104115 | 7/1983 | A45D/34/04 |
| JP | 59-16514 | 2/1984 | A45D/34/06 |
| JP | 61-62855 | 4/1986 | B65D/51/32 |
| JP | 5-31713 | 4/1993 | A45D/34/00 |
| JP | 6-66512 | 9/1994 | A45D/34/00 |

* cited by examiner

*Primary Examiner*—Kevin Shaver
*Assistant Examiner*—Stephanie Willatt
(74) *Attorney, Agent, or Firm*—Jacobson Holman PLLC

(57) ABSTRACT

The present invention relates to a cosmetic container, and more particularly, to a cosmetic container which is constructed to facilitate elevating and lowering of a brush, and opening and closing of upper and lower caps through an interaction between the caps, in order to solve inconvenience where the brush is naturally deformed by the contents in a container (vessel) when liquid cosmetics such as lip gloss, eyeliner, eye shadow or manicure are put into and used within the container. A cosmetic cosmetic comprises a container body having a threaded portion provided on an opening portion thereof, a packing body seated on the opening portion, an upper cap and an elevating holder for elevating and lowering the brush, and a lower cap for separating all the caps from the container. Further, grooves having a predetermined rotating range for elevating and lowering the elevating holder are formed on the upper and lower caps, respectively, so as to cause the caps to be integrally formed with the elevating holder, and the brush is constructed such that it can be stored into a brush protecting tube by rotating the caps. Accordingly, an excessive quantity of the cosmetics is prevented from being taken out, by means of the wiping action of the wiper provided in the packing body, when separating the cap from the cosmetic container.

3 Claims, 6 Drawing Sheets

COSMETIC CONTAINER

This is a nationalization of PCT/KR01/01241 filed Jul. 20, 2001 and published in English.

TECHNICAL FIELD

The present invention relates to a cosmetic container, and more particularly, to a cosmetic container which is constructed to facilitate elevating and lowering of a brush for protection and use of the brush, respectively, and to facilitate opening and closing of upper and lower caps through an interaction between the caps, in order to solve inconvenience where the brush is naturally deformed by the contents in a container (vessel) when liquid cosmetics such as lip gloss, eyeliner, eye shadow or manicure are put into and used within the container.

BACKGROUND ART

Of the methods of using such liquid cosmetics, there are techniques of using a separate brush to which a cosmetic solution has been adhered by dipping the brush into the cosmetic solution filled in a cosmetic container, or of using a brush to which a cosmetic solution has been adhered by causing the brush to be dipped into the cosmetic solution when locking a cap integrally formed with the brush and a brush rod. In a case where the cosmetic solution had been adhered to the brush in this way, use proved very inconvenient because the cosmetic solution, excessively adhered to the brush, streams down the brush rod or runs down from a tip of the brush rod. Conventional techniques for solving these problems have been mostly developed abroad where cosmetic culture is highly advanced. Among them, a method for wiping off the brush rod has mainly been developed.

In U.S. Pat. No. 4,886,387, a cosmetic container is disclosed which comprises a container having an open and closed end, a brush rod having a brush and an elongated rod integrally formed with a cap, a wiper provided on an upper portion of an inner surface of the container for wiping off the brush rod and the brush, and an additional wiper provided in an additional chamber located at a lower portion of the inner surface of the container for wiping off the brush. The brush rod integrally formed with the cap is made in such a manner that it can be conveniently picked up with the fingers, and so that two wipers are provided for wiping off the cosmetic solution adhered to the brush and brush rod. However, the wiper provided in the lower portion of the container does not sufficiently fulfill its own function, because the cosmetic solution removed at the lower portion of the container adheres again to the brush. Further, since the brush is also formed perpendicular to the brush rod, bristles of the brush are bent toward one direction if it has been used for a long time. Therefore, there is a problem in that the brush does not fully perform its own function.

Furthermore, in U.S. Pat. No. 4,927,281, a brush for applying makeup products and a cosmetic container are disclosed. The brush of the patent includes a plurality of bristles held between the spirals of at least two branches of a helically twisted metal wire, and the cosmetic container of the patent is divided into a cap portion and a container portion. The cap portion is integrally formed with a brush rod so that the brush and the brush rod can be separated from the container by unfastening threads provided on an opening portion of the container. At this time, the cosmetic solution, which is adhered to the brush rod and formed on the brush, can be properly removed by means of a wiper provided in the opening portion of the container. In such a case, when compression force of the wiper is overly strong, a desired quantity of the cosmetics required for makeup may not be applied to the brush since the wiper excessively tightens the brush, and furthermore, the brush may be bent or deformed.

In addition, according to domestic techniques similar to the aforementioned techniques, the container is designed so that the liquid cosmetics adhered to the brush rod and the brush can be properly removed, by inserting a packing body for the wiper into the opening portion of the container so as to wipe off the brush.

DISCLOSURE OF INVENTION

The present invention is contemplated to solve such problems in the prior arts. An object of the present invention is to prevent an excessive quantity of the liquid cosmetics from being applied to a brush and also from being moved out by providing a packing body constituting a wiper to an opening portion of a container, to prevent the brush from being damaged directly by the wiper by providing a brush protecting tube by which deformation of the brush can be produced although the brush is drawn out several times, and to safely protect the brush by providing guide grooves for putting the brush into the brush protecting tube, which can be rotated with respect to both an upper cap and a lower cap, and by moving the brush up and down through the brush protecting tube.

The present invention is directed to a cosmetic container, and more particularly, to a cosmetic container which is designed to facilitate elevating and lowering of a brush and opening and closing of caps through mutual rotation of upper and lower caps when liquid cosmetics such as mascara, manicure or the like are used. The cosmetic container of the present invention comprises a container body having a threaded portion provided on an opening portion thereof, a packing body firmly seated on the opening portion of the container body, an upper cap and an elevating holder for elevating and lowering the brush, and a lower cap having female threads for separating the cap from the container.

The caps of the cosmetic container are divided into the upper cap and the lower cap. Guide projections of the elevating holder are fitted into respective grooves, i.e., lead grooves and double spiral guide grooves so that an inner surface of the upper cap abuts against an outer surface of the lower cap. The guide projections move along the lead grooves and the double spiral guide grooves by rotating the upper cap and the lower cap in the directions opposite to each other. Consequently, the elevating holder, which has been integrally formed with the brush rod, is elevated or lowered. In addition, when the brush is taken out of the cosmetic container body by rotating the lower cap, the elevating holder, including a guide rod and the brush, is taken out together with the brush. At this time, liquid cosmetics adhered to the elevating holder and the brush are wiped off by the wiper provided in the packing body, and thus the excessive quantity of the cosmetics adhered to the brush can be prevented from coming out.

BEST MODE FOR CARRYING OUT THE INVENTION

Hereinafter, an embodiment of the present invention will be explained in detail with reference to the accompanying drawings.

Figure 1:
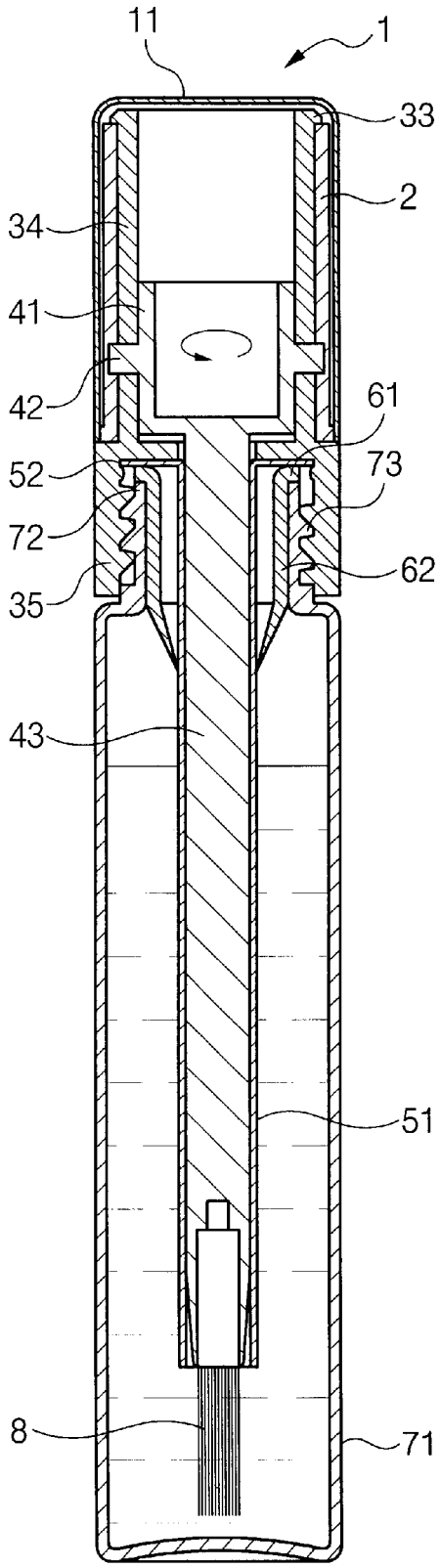
FIG. 1 is a sectional view of a cosmetic container according to the present invention.

FIG. 1 is a sectional view of a cosmetic container according to the present invention, and shows a state where an upper cap 2, a lower cap 3, a packing body 6 and an elevating holder 4 are all assembled together in the cosmetic container filled with liquid cosmetics in a desired amount. The packing body 6 seated on an opening portion 72 of the cosmetic container is installed to prevent the liquid cosmetics in a container portion 71 from escaping to the outside when the container is tilted. Further, the wiper 62 wipes a brush protecting tube 5 when a brush rod 43 is taken out of the container. At this time, the packing body 6 is also in close contact with an inner surface of the opening portion 72 so as not to be removed therefrom. The brush protecting tube 5 is placed on the packing body 6 and is fitted to the projection where female threads formed on an inner surface of the lower cap 3 comes to an end, so that it can be fixed to the lower cap 3. Accordingly, the brush protecting tube 5 is constructed to be withdrawn together with the cap 1 when removing the cap 1. The brush protecting tube 5 is intended to store the elevating holder 4 including the brush rod 43 and a brush 8 thereinto, and the brush 8 may be positioned either inside or outside the brush protecting tube 5 depending on the upward and downward movements of the elevating holder 4. Furthermore, the upper cap 2 and the lower cap 3 are coupled with each other by engaging guide projections 42 of the elevating holder 4 into the double spiral grooves 21 and the lead grooves 31, and the inner surface of the upper cap 2 abuts against a lead tube 34 of the lower cap 3 so as to form a cap assembly which can be separated from a container body 7. On the other hand, a cap 1 is press-fitted to a contact projection 22 formed on an outer peripheral surface of the upper cap 2, or is bonded by adhesive and the like to the contact projection 22, so that the upper cap 2 can be rotated as an enclosure cap 11 rotates.

Figure 2:
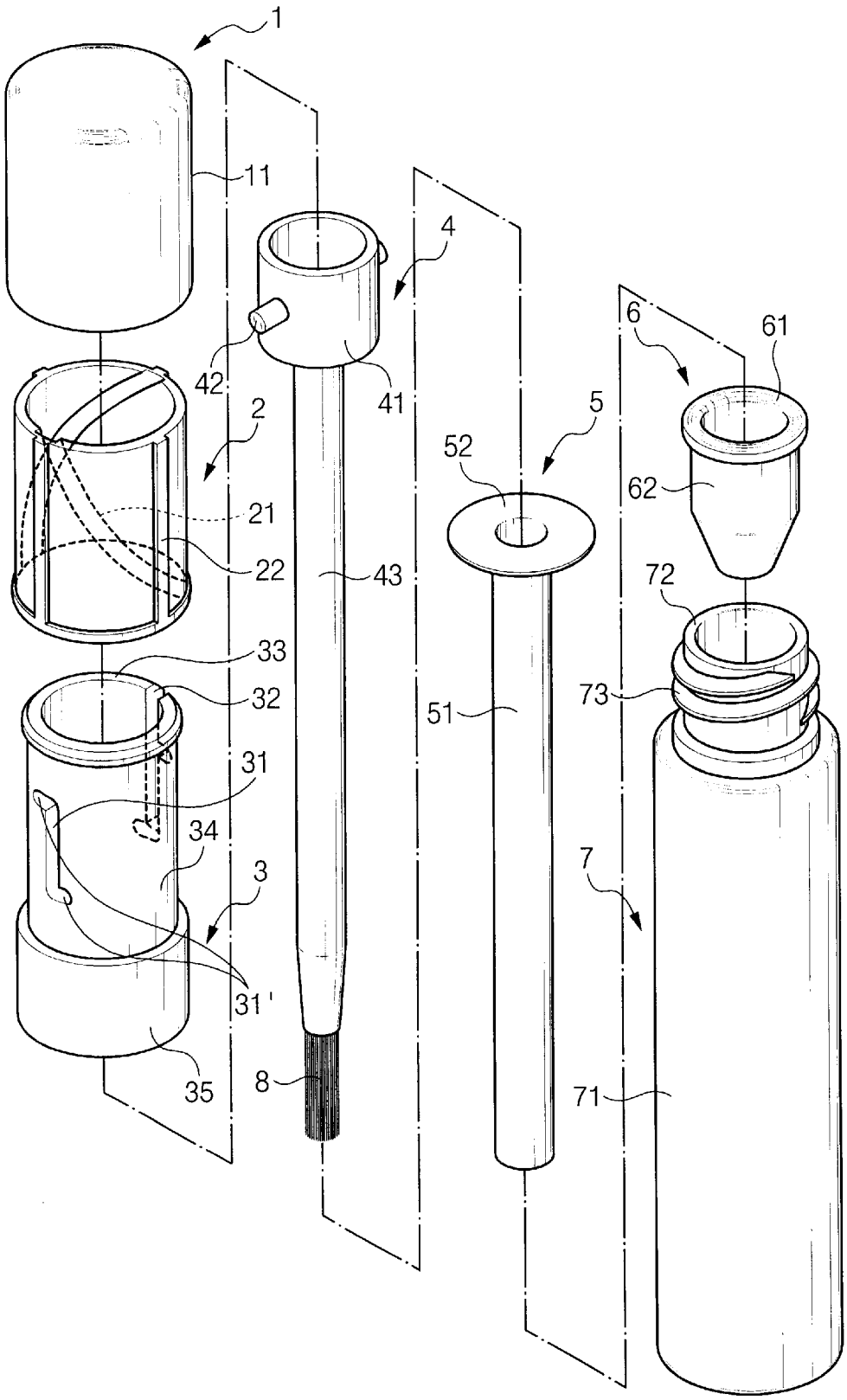
FIG. 2 is an exploded perspective view of the cosmetic container according to the present invention.

FIG. 2 is an exploded perspective view of the cosmetic container according to the present invention. In this figure, respective parts are shown according to the order of their assembly from the right side thereof. First, the packing body 6 is fitted into the opening portion 72 of the container body 7. A guide rod 51 of the brush protecting tube 5 is inserted into a hole of the packing body 6, and the elevating holder 4 is then inserted into the brush protecting tube 5. The guide projections 42 protruded from a top portion of the elevating holder 4 are first fitted into the lead grooves 31 so that the guide projections 42 can move along the lead grooves 31. Then, the guide projections 42 protruded further outside of the lead grooves 31 of the lower cap 3 are fitted again into the double spiral guide grooves 21 formed at the inner surface of the upper cap 2 so as to restrict the movements of the upper cap 2 and the lower cap 3 and at the same time to cause the upper cap 2 and the lower cap 3 to be united. In addition, in order to prevent the upper cap 2 from escaping out of the guide projections 42 and to facilitate elevating and lowering the brush 8, the enclosure cap 11 is provided to cover the upper cap 2. Here, an upper end of the packing body 6 is formed with a fixing projection 61 so that the projection can be seated on the opening portion 72 of the container body 7. Further, in order to wipe off the liquid cosmetics adhered to the brush protecting tube 5, the brush protecting tube 5 is fitted into a lower end of the packing body 6 in a state where there is no clearance between an outer diameter of the brush protecting tube 5 and an inner diameter of the wiper 62. Furthermore, an upper end portion of the wiper 62 is formed to have a diameter larger than the inner diameter of the brush protecting tube 5 such that the brush protecting tube 5 can be easily withdrawn therefrom, and a lower end portion thereof has a conical shape that is tilted inwardly to form a predetermined angle from a portion located at a length or more corresponding to a depth of the opening portion 72. Also, a distal end of the wiper 62 forms a pointed end. The elevating holder 4 comprises a head 41 thereof, the brush rod 43 and the brush 8. On the outer peripheral surface of the head 41 of the elevating holder, the guide projections 42 having a height somewhat greater than a depth of the lead grooves 31 of the lower cap 3, i.e., a thickness of the lower cap 3 are formed oppositely. Moreover, a lower portion of the brush rod 43 is tapered to have a predetermined slant so that the brush 8 can be smoothly inserted into the brush protecting tube 5. The lower cap 3 has a lead groove entrance 32 into which the guide projections 42 of the elevating holder 4 can be introduced. The lead grooves 31 are formed vertically as far as a range of up and down movement of the brush, so that the elevation of the stand 4 can be induced through sliding movement of the guide projections 42 of the elevating holder 4 along the lead grooves 31 according to the rotation of the upper cap 2, and stopping grooves 31' are provided so that the elevating holder 4 can neither elevate nor lower beyond predetermined heights, i.e., a top dead point and a bottom dead point. On the other hand, a lower cap fixing projection 33 having a predetermined height is formed on an upper end of the lower cap 3 such that it can be fitted into the upper cap 2 and fixed on an upper portion of the upper cap 2. On the contrary, a lower end of the lower cap 3 is formed to have a step over which the upper cap 2 is placed. In a state where the lower cap 3 and the elevation rod 4 are engaged with each other, the lower cap 3, the upper cap 2 and the elevating holder 4 are coupled together by inserting the guide projections 42 of the elevating holder 4 into and rotating them along the double spiral guide grooves 21 formed at a bottom portion on the inner surface of the upper cap 2. Finally, the double spiral guide grooves 21 are oppositely manufactured so that they can rotate within an angle range of 90° to 180°.

Figure 3:
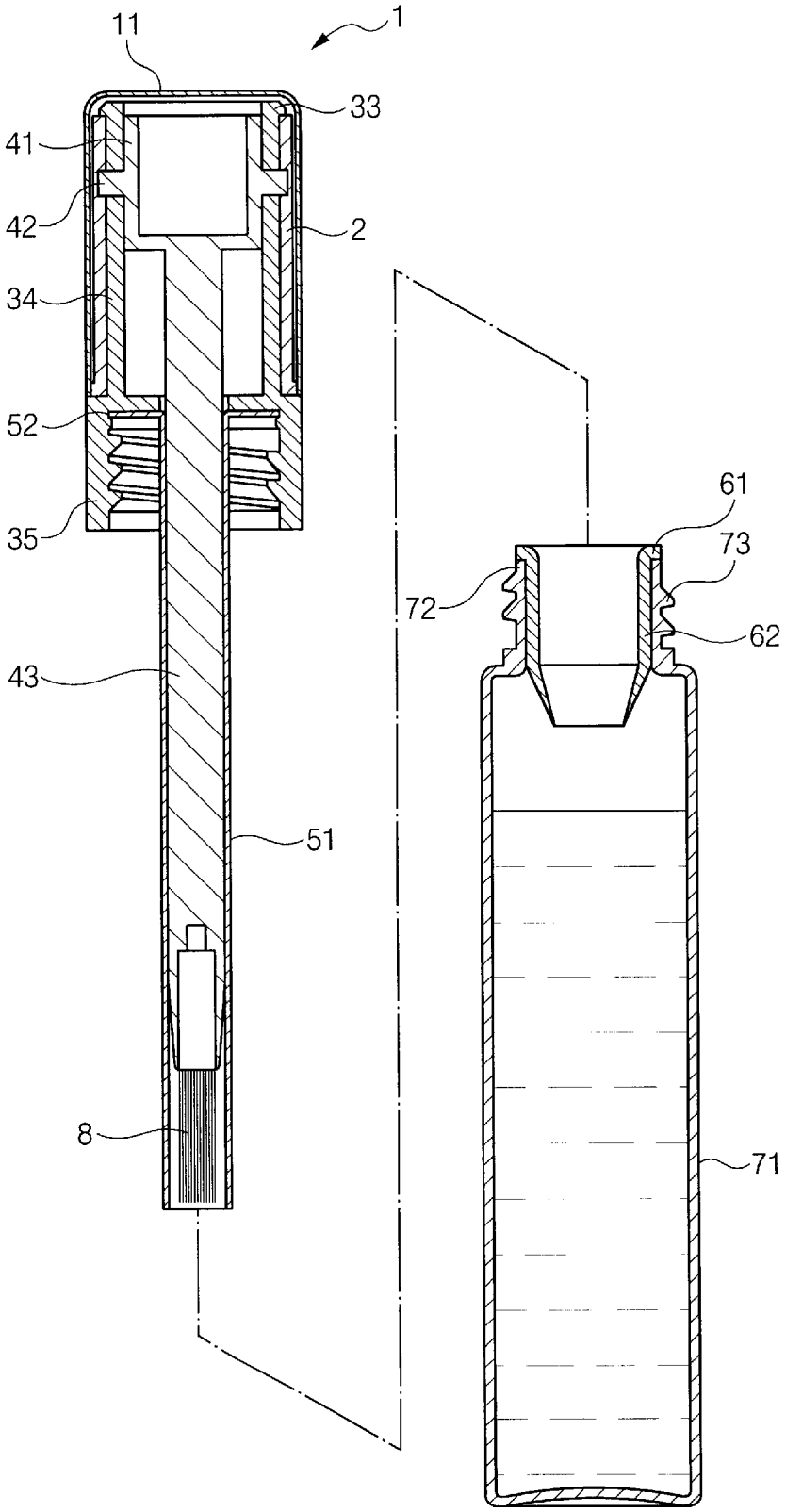
FIG. 3 is a sectional view with a cap and a container body being separated.

FIG. 3 is a sectional view of the container with the cap and the container body being separated, and shows a state where the upper cap 2 has been rotated to cause the brush 8 to be elevated into the brush protecting tube 5 while the cap 1 has been separated from the container body 7. As shown in this figure, a sealing disk 52 of the brush protecting tube 5 is fixed to a projection 61 formed at an end of the threaded portion of the brush protecting tube 5.

Figure 4:
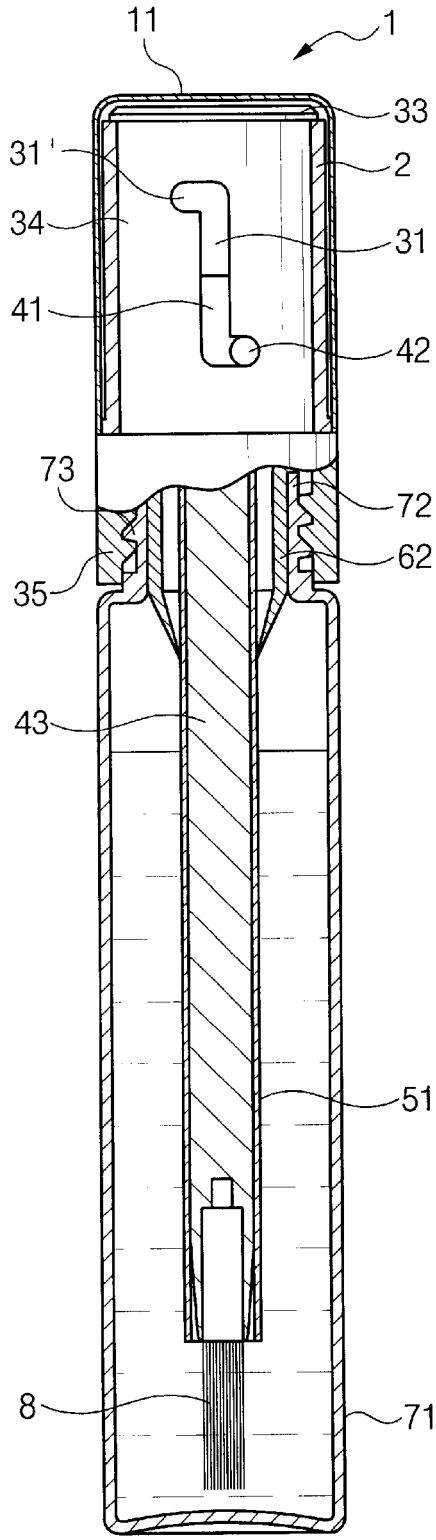
FIG. 4 is a sectional view of the cosmetic container with the brush being lowered.

FIG. 4 is a sectional view of the cosmetic container with the brush being lowered, and shows a state where the upper cap 2 has been rotated to cause the brush 8 to protrude out of the brush protecting tube 5 while all the caps are closed with the cosmetic container body 7. In such a case, the guide projections 42 are positioned at lower portions of the double spiral guide grooves 21 of the upper cap 2 and the lead grooves 31 of the lower cap 3, respectively, and thus they stop rotating further by means of the stopping grooves 31' of the lower cap 3.

Figure 5:
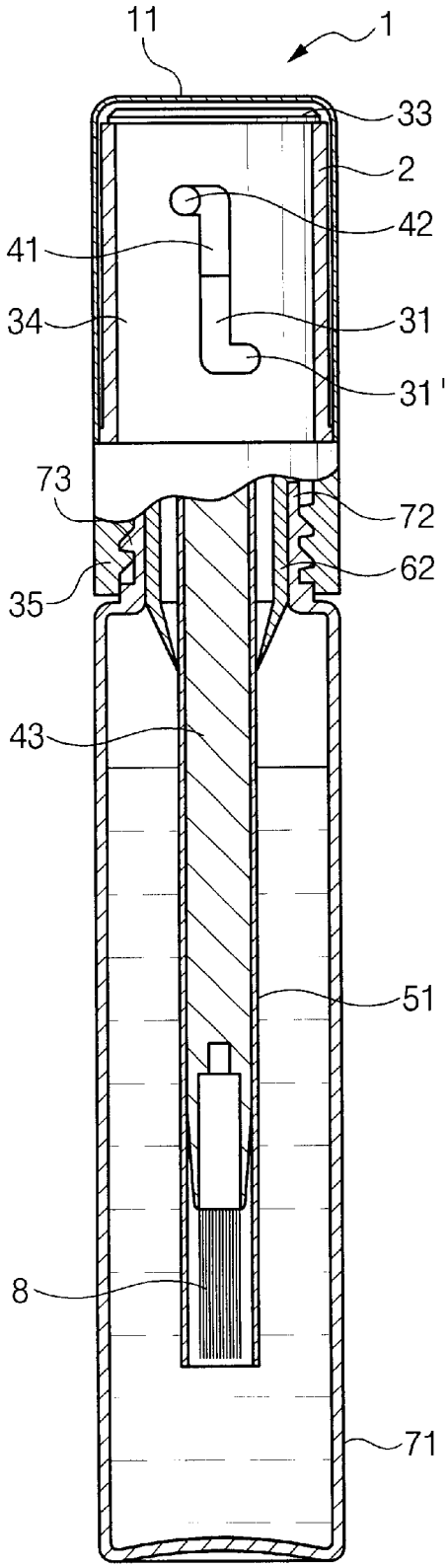
FIG. 5 is a sectional view of the cosmetic container with the brush being elevated.

FIG. 5 is a sectional view of the cosmetic container with the brush being elevated, and shows a state in section where the brush 8 is retracted into the brush protecting tube 5 by causing the upper cap 2 to rotate in a direction opposite to that in FIG. 4, while the cosmetic container body 7 is stopped with all the caps. In such a case, the guide projections 42 are positioned at upper portions of the double spiral guide grooves 21 of the upper cap 2 and the lead grooves 31 of the lower cap 3, respectively, and thus they stop rotating further by means of the stopping grooves 31' of the lower cap 3.

Figure 6:
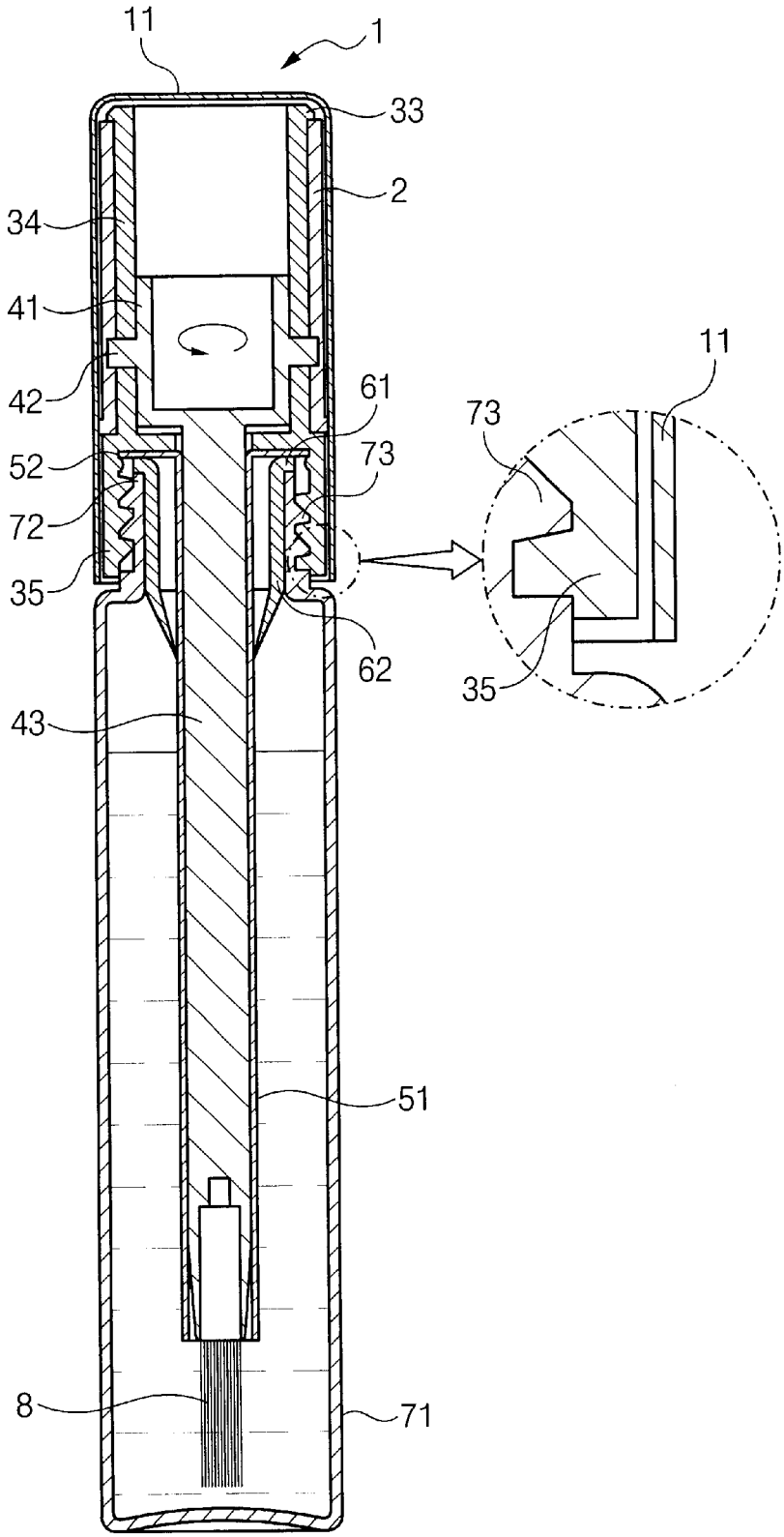
FIG. 6 is a sectional view of another embodiment according to the present invention.

FIG. 6 is a view showing another embodiment of the present invention. The constitution shown in this figure is the same as the cosmetic container according to the aforementioned embodiment of the present invention, except that the enclosure cap 11 is extended further from the lower end of the upper cap 2 to a turning handle 35 of the lower cap 3 and covers all of them so that respective caps can be united. The long enclosure cap 11 is made of a little flexible material, and may be used as follows. In order to elevate the brush 8 into or lower it from the brush protecting tube 5, a user can grasp and turn an upper portion of the long enclosure cap 11 in the same manner as the aforementioned embodiment of the present invention. Alternatively, in order to separate the cap 1 and the brush 8 from the container body 7 of the cosmetic container, the user can also closely grasp and turn a lower end portion of the long enclosure cap 11. Accordingly, the cap and the brush are separated from the container body 7.

As described in the foregoing, the cosmetic container of the present invention is characterized in that it is designed to prevent damage of the brush 8 when the brush 8 is taken out, in that it is designed to store the brush 8 in the brush protecting tube 5, and in that it is designed to prevent the excessive quantity of cosmetic from being removed.

According to the cosmetic container of the present invention, an excessive quantity of cosmetics can be prevented from leaking into the brush protecting tube by means of the wiper that is positioned under the packing body fitted into the container body. Further, since the brush can be stored through up and down movements of the brush rod along the grooves of the upper and lower caps that has been designed to rotate mutually, deformation and damage of the brush can be prevented although the brush is frequently taken out of the cosmetic container.

What is claimed is:

1. A cosmetic container comprising a container body 7 which has a space for accommodating contents and in which a threaded portion 73 is formed at a peripheral portion of an opened top portion thereof, a packing body 6 engaged with an opening portion 72 of the container body (7) for regulating the quantity of the contents to be escaped from the container, a brush rod 43 which has a predetermined length and to which a brush 8 is fixed at a lower end thereof, and a sealing cap 1 in which female threads engaged with the threaded portion 73 of the container body 7 are formed, characterized in that:

said cap 1 comprises a lower cap 3 and an upper cap 2 covered with an enclosure cap 11, which are engaged with each other;

said upper cap 2 is constructed in such a manner that double spiral guide grooves 21 having a predetermined rotational angle, of, 90°~180° are formed on an inner surface thereof, and contact projections 22 are formed on an outer peripheral surface thereof, whereby said upper cap can be press-fitted or adhesive bonded to an inner surface of said enclosure cap 11;

said lower cap 3 is constructed in such a manner that a fixing projection 33, which is caught on an upper end of said upper cap when said lower cap is inserted into said upper cap, is formed on an upper end thereof, lead grooves 31 having a length corresponding to a limit of up and down movement of said brush 8 are formed vertically and oppositely to each other, and a turning handle 35, with female threads formed therein, for opening and closing said cap are formed on a lower portion thereof, said female threads being extended from a lower end of said lower cap 3 and engaged with said threaded portion 73 of said container body 7;

a brush protecting tube 5 is constructed in such a manner that a sealing disk 52 is formed on a top portion thereof to be fitted into and engaged with said lower cap 3, and a guide rod 51 extending from a central portion of said sealing disk 52 by a predetermined length is integrally formed therewith so as to be contacted with and fitted into said packing body 6 engaged with said container body 7; and an elevating holder 4 is constructed in such a manner that guide projections 42 fitted into said double spiral guide grooves 21 of said upper cap 2 and said lead grooves 31 of said lower cap 3 are formed to protrude from an upper portion thereof, said elevating holder comprising said brush rod 43 with said brush 8 formed at said lower end of said brush rod, whereby said brush 8 can be moved into or out of said guide rod 51 of said brush protecting tube 5 when said elevating holder 4 is elevated or lowered by rotating said upper cap 2.

2. The cosmetic container as claimed in claim 1, wherein stopping grooves 31' are formed, perpendicularly to said lead grooves and oppositely to each other, at said upper and lower ends of said lead grooves 31 of said lower cap 3, such that said elevation rod 4, moving upwardly and downwardly, can come to an end after said stand has reached either a top dead point or a bottom dead point.

3. The cosmetic container as claimed in claim 1, wherein said enclosure cap 11 is extended from said lower end of said upper cap 2 to said lower end of said turning handle 35 with a predetermined space formed between said turning handle 35 of said lower cap 3 and said enclosure cap 11.

* * * * *